US008494864B2

(12) United States Patent
Grancharov et al.

(10) Patent No.: US 8,494,864 B2
(45) Date of Patent: Jul. 23, 2013

(54) MULTI-MODE SCHEME FOR IMPROVED CODING OF AUDIO

(75) Inventors: Volodya Grancharov, Solna (SE); Stefan Bruhn, Sollentuna (SE); Harald Pobloth, Taby (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 275 days.

(21) Appl. No.: 12/996,959

(22) PCT Filed: Jun. 24, 2008

(86) PCT No.: PCT/SE2008/050758
§ 371 (c)(1),
(2), (4) Date: Feb. 24, 2011

(87) PCT Pub. No.: WO2009/157824
PCT Pub. Date: Dec. 30, 2009

(65) Prior Publication Data

US 2011/0153336 A1 Jun. 23, 2011

(51) Int. Cl.
*G10L 19/00* (2006.01)

(52) U.S. Cl.
USPC ..... 704/500; 704/200; 704/501

(58) Field of Classification Search
USPC ..... 704/200–201, 230, 500–504
See application file for complete search history.

(56) References Cited

U.S. PATENT DOCUMENTS

| | | | | |
|---|---|---|---|---|
| 5,651,090 | A * | 7/1997 | Moriya et al. | 704/200.1 |
| 8,069,035 | B2 * | 11/2011 | Yoshida | 704/201 |
| 2006/0265087 | A1 * | 11/2006 | Philippe et al. | 700/94 |
| 2007/0192086 | A1 * | 8/2007 | Guo et al. | 704/200.1 |
| 2008/0097763 | A1 * | 4/2008 | Van De Par et al. | 704/500 |
| 2009/0138271 | A1 * | 5/2009 | Christensen et al. | 704/500 |

OTHER PUBLICATIONS

International Search Report, PCT Application No. PCT/SE2008/050758, Feb. 16, 2009.
Written Opinion of the International Searching Authority, PCT Application No. PCT/SE2008/050758, Feb. 16, 2009.
International Preliminary Report on Patentability, PCT Application No. PCT/SE2008/050758, May 24, 2010.

* cited by examiner

*Primary Examiner* — Douglas Godbold
(74) *Attorney, Agent, or Firm* — Myers Bigel Sibley & Sajovec, P.A.

(57) ABSTRACT

The present invention relates to an improved scheme for coding of audio. In particular, the present invention relates to an encoder device and a method for coding an input signal in an encoder system. The method comprises applying a first mode to the input signal to form a first output and applying a second mode to the input signal to form a second output. A first processed output is then formed from at least a part of the first output, and a second processed output is formed from at least a part of the second output. Forming a second processed output comprises estimating a part of the input signal from at least a part of the second output. Then, an optimum mode is determined based on the first processed output and the second processed output, and the output according to the optimum mode is selected.

16 Claims, 10 Drawing Sheets

MULTI-MODE SCHEME FOR IMPROVED CODING OF AUDIO

CROSS REFERENCE TO RELATED APPLICATION

This application is a 35 U.S.C. §371 national stage application of PCT International Application No. PCT/SE2005/050758, filed on 24 Jun. 2008, the disclosure and content of which is incorporated by reference herein in its entirety. The above-referenced PCT International Application was published in the English language as International Publication No. WO 2009/157824 A1 on 30 Dec. 2009.

TECHNICAL FIELD

The present invention relates to an improved scheme for coding of audio. In particular, the present invention relates to an encoder device and a method for coding an input signal in an encoder system.

BACKGROUND

A conventional solution for coding, e.g. audio, is to quantize low-frequency regions of the input signal in an encoder, and reconstruct high-frequency regions of the spectra at the decoder according to a reconstruction codebook. In this way all bits are allocated to the frequency components below a pre-defined frequency threshold or index, and at the decoder the remaining (unquantized) frequency components are reconstructed from the quantized frequency components.

A more advanced solution, which is suitable for variable bit rates, is to dynamically detect the regions to be quantized and regions to be reconstructed based on, e.g., the energy in frequency bands of the input.

Furthermore, it has been proposed to adjust the size of regions to be quantized based on the degree of difficulty for encoding the regions of the input signal in question. The region is smaller when it contains a spectrum that is difficult to quantize, and vice versa.

In spite of the above mentioned, there is still a need for an improved scheme for audio coding.

SUMMARY

Accordingly, it is an object of the present invention to provide an encoder device and a method for provision of a coding scheme enabling improved audio quality at a receiving terminal.

A method for coding an input signal in an encoder system is provided. The method comprises applying a first mode to the input signal to form a first output and applying a second mode to the input signal to form a second output. A first processed output is then formed from at least a part of the first output, and a second processed output is formed from at least a part of the second output. Forming a second processed output comprises estimating a part of the input signal from at least a part of the second output.

An optimum mode based on the first processed output and the second processed output is then determined, and the output according to the optimum mode is selected.

Further, an encoder device is provided. The encoder device comprises a controller and an encoder unit connected to the controller. The encoder unit is arranged for applying a first mode to an input signal to form a first output and arranged for applying a second mode to the input signal to form a second output. The controller is arranged for forming a first processed output from at least a part of the first output, and a second processed output from at least a part of the second output. In the controller, forming a second processed output comprises estimating a part of the input signal from at least a part of the second output. Further, the controller is arranged for determining an optimum mode based on the first processed output and the second processed output, and arranged for selecting the output according to the optimum mode.

It is an important advantage of the present invention that an optimum mode for encoding is selected from a number of modes such that the quality of an audio signal transmission is improved.

During quantization of an input signal, quantization errors are introduced due to the limited number of available bits. A higher precision for the quantization may be obtained by quantizing only a selected part of the input signal and reconstructing the remaining part. Reconstruction of a signal, e.g. unknown high-frequency components from known quantized low-frequency components, introduces reconstruction artifacts in the resulting output signal. Thus there is a tradeoff between quantization errors and reconstruction artifacts when encoding an input signal.

According to the present invention, an optimum mode corresponding to an optimum output is determined and selected from a plurality of modes including a first mode and a second mode based on a processing, e.g. including decoding, of the outputs resulting from application of the plurality of modes to the input signal.

BRIEF DESCRIPTION OF THE DRAWINGS

The above and other features and advantages of the present invention will become readily apparent to those skilled in the art by the following detailed description of exemplary embodiments thereof with reference to the attached drawings, in which.

ABBREVIATIONS

Figure 1:
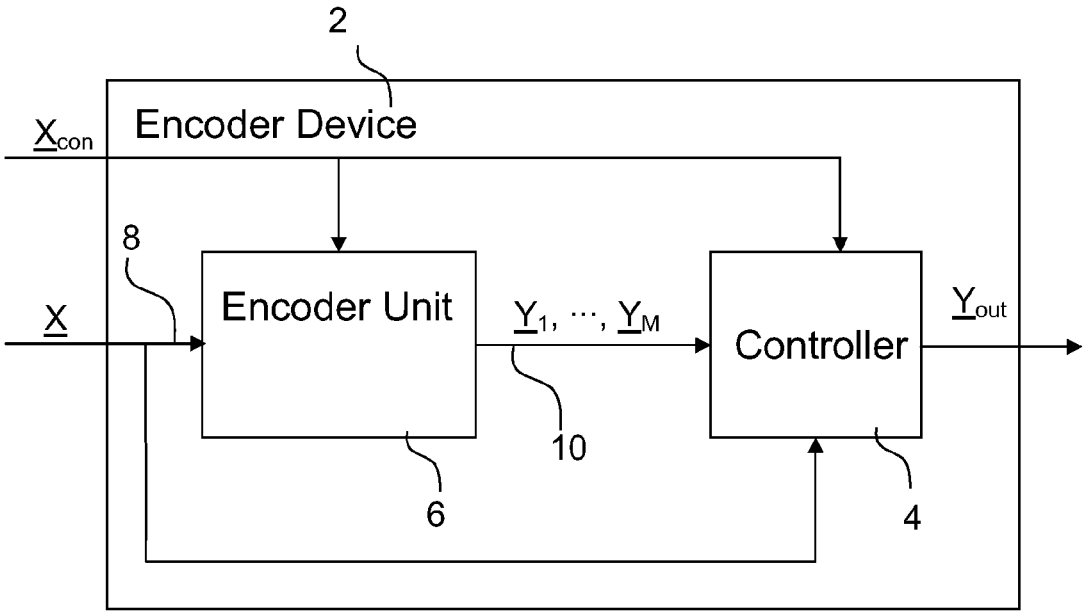
FIG. 1 schematically illustrates an embodiment of the encoder device according to the present invention, FIG. 2 schematically illustrates an embodiment of the encoder device according to the present invention, FIG. 3 schematically illustrates an embodiment of an encoder unit of FIG. 1, FIG. 4 schematically illustrates an embodiment of a controller of FIG. 1, FIG. 5 schematically illustrates an embodiment of an encoder unit of FIG. 2, FIG. 6 schematically illustrates an embodiment of a controller of FIG. 2, FIG. 7 schematically illustrates an embodiment of an encoder device according to the present invention.

AR auto-regressive
BWE bandwidth extension
DFT discrete Fourier transform
GMM Gaussian mixture models
KLT Karhunen Loeve transform
MDCT modified discrete cosine transform SBR spectral band replication
SQ scalar quantizer
VQ vector quantizer

DETAILED DESCRIPTION

The figures are schematic and simplified for clarity, and they merely show details which are essential to the understanding of the invention, while other details have been left out. Throughout, the same reference numerals are used for identical or corresponding parts.

The method according to the invention comprises applying a plurality of modes including a first mode and a second mode to the input signal. The input signal may be preprocessed, e.g. by application of a spectral envelope prior to the application of the modes.

Applying a mode to the input signal may comprise quantizing a selected part of the input signal, e.g. applying a first mode to the input signal may comprise quantizing a first part of the input signal and/or applying a second mode to the input signal may comprise quantizing a second part of the input signal. The first part and the second part may overlap.

An exemplary mode is where frequencies or coefficients of the input signal below or up to a quantization threshold are quantized leaving the frequencies or coefficients above the quantization threshold to be reconstructed. Different quantization thresholds may characterize different modes.

In the method, forming a second processed output may comprise reconstructing a part of the input signal using bandwidth extension.

In the method according to the invention, a suitable number M of modes may be applied to the input signal to form M outputs. In an embodiment, selected or preferably all outputs are processed to form processed outputs. Selected or preferably all processed outputs may partly or fully form basis for the determination of the optimum mode.

In the method, determining an optimum mode may comprise determining the optimum mode based on a selection criterion calculated from the input signal and the processed first output and the processed second output.

The selection criterion may be defined as a minimization problem given as:

$$m^{(*)}=arg\min_m D(\underline{X},\underline{Y}_{m,proc}),$$

where $m^{(*)}$ is the optimum mode, D is the distortion, $m=(1,\ldots,M)$ is the index over M modes, $\underline{X}=(x_0,\ldots,x_{N-1})$ is the input signal, and $\underline{Y}_{m,proc}=(y_0,\ldots,y_{N-1})_{m,proc}$ is the processed output for mode m.

If the computation of the criterion $D(\underline{X},\underline{Y}_{m,proc})$, for all modes M imposes a too high complexity, it is possible to calculate the criterion for only a subset of all modes and/or for only a subset of coefficients. Then the criterion may be interpolated for the remaining modes. This allows having more modes to choose from than criteria to calculate and saves the computation of D and $\underline{Y}_{m,proc}$ for the modes that the criterion is interpolated to. In other words: A high resolution in the transition from coding to BWE is achieved while the computational complexity of the algorithm is kept low.

In an embodiment, the selection criterion may be defined as a minimization problem given as:

$$m^{(*)}=arg\min_m D(\underline{X},\underline{Y}_{m,proc}),$$

where $m^{(*)}$ is the optimum mode, D is the distortion, m is the index over a subset of M modes, $\underline{X}=(x_0,\ldots,x_{N-1})$ is the input signal, and $\underline{Y}_{m,proc}=(y_0,\ldots,\overline{y}_{N-1})_{m,proc}$ is the processed output for mode m.

The distortion D may for at least one mode, e.g. selected or all modes, be given by:

$$D=\frac{1}{N}\sum_{n=0}^{N-1}(x_n^*-y_n^*)^{\beta_n},$$

where N is the number of coefficients in the input signal, $$x^*_0=|x_0| \text{ and } x^*_n=(1-\alpha_n)|x_n|+\alpha_n x^*_{n-1} \text{ for all } 1\leqq n<N,$$

$$y_0=|y_0| \text{ and } y^*_n=(1-\alpha_n)|y_n|+\alpha_n y^*_{n-1} \text{ for all } 1\leqq n<N.$$

The weighting factor $\alpha_n$ may be given by:

$$\alpha_n=\left(\frac{n}{N}\right)^6$$

and/or the penalty factor $\beta_n$ may be a constant, e.g. $\beta_n=2$, or preferably given by:

$$\beta_n=\begin{cases}4, \text{ if } (x_n^*-y_n^*)<0\\ 2, \text{ if } (x_n^*-y_n^*)\geq 0.\end{cases}$$

In an embodiment, the distortion D may for at least one mode, e.g. selected or all modes, be given by:

$$D=\frac{1}{N_I}\sum_{n\in I}(x_n^*-y_n^*)^{\beta_n},$$

where N is the number of coefficients in the input signal, I is a subset of integers from 0 to N−1, $N_I$ is the number of elements in I, $$x^*_0=|x_0| \text{ and } x^*_n=(1-\alpha_n)|x_n|+\alpha_n x^*_{n-1} \text{ for all } 1\leqq n<N,$$

$$y^*_0=|y_0| \text{ and } y^*_n=(1-\alpha_n)|y_n|+\alpha_n y^*_{n-1} \text{ for all } 1\leqq n<N.$$

The weighting factor $\alpha_n$ may be given by:

$$\alpha_n=\left(\frac{n}{N}\right)^6,$$

and/or the penalty factor $\beta_n$ may be a constant or preferably given by:

$$\beta_n=\begin{cases}4, \text{ if } (x_n^*-y_n^*)<0\\ 2, \text{ if } (x_n^*-y_n^*)\geq 0.\end{cases}$$

In an embodiment, the distortion D may for at least one mode, e.g. selected or all modes, be estimated.

The method may include the step of including the selected output signal according to the optimum mode in an encoder device output signal, i.e. transmitting the selected output signal. Information about the selected optimum mode may be transmitted with the selected output signal.

Typically the input signal is divided into frames by the encoding device. The optimum mode may then be determined for each frame or at a selected frequency, e.g. one output determination per ten frames of the input signal.

Typically in coding of audio, the audio signal is digitalized and transformed, e.g. by Modified Discrete Cosine Transform (MDCT).

Preferably, the input signal to the encoder device is a digitalized and transformed input signal. If the input signal is in the time domain, the encoder device may comprise a transformation unit, e.g. a MDCT unit, in order to provide a transformed input signal to preprocessor or encoder unit.

Preferably, the modes to be applied to the input signal are characterized by the dimensions of the input signal vector that are considered for quantization, e.g. a first set of dimensions considered for quantization is associated to a first mode, a second set of dimensions considered for quantization is associated to a second mode, etc. The different sets may overlap, i.e., share some elements. The optimal number of modes will depend on the total bit budget and constraints on computational complexity. The number of modes can be any positive integer larger than two. In the present description two modes are considered for simplicity and at other places four modes are considered for illustration.

The encoder device according to the invention may be arranged for performing the steps of the method according to the invention.

The encoder unit of the encoder device may comprise one or more encoders including an encoder being adapted to serially apply a plurality of modes, e.g. the first mode and the second mode, and serially forward the outputs, e.g. the first output and the second output, to the controller, e.g. on a first connection. The encoding may comprise quantization, compression, and/or normalization.

The encoder unit may comprise a first encoder and a second encoder, wherein the first encoder is arranged for applying the first mode and arranged for forwarding the first output to the controller on a first connection, and the second encoder is arranged for applying the second mode and arranged for forwarding the second output to the controller on a second connection.

The encoder unit may comprise a preprocessor. The preprocessor may be adapted for applying a spectral envelope to the input signal and feeding the resulting residual signal to the encoder(s).

The controller may be adapted to determine the optimum mode among the applied modes and forward the corresponding output signal. The controller may comprise at least one decoder arranged for processing outputs, e.g. the first output and the second output, according to the corresponding modes, e.g. according to the first and second mode, respectively. Further the controller may comprise a processor arranged for determining the optimum mode based on a selection criterion calculated from the input signal and the processed or decoded outputs, e.g. the first processed output and the second processed output. The processed output of at least one of the outputs may comprise a reconstructed part, i.e. a part of the decoded or processed signal is estimated or reconstructed, e.g. by bandwidth extension. The transmitter and receiver reconstruction codebooks for a given mode are generated from the output that the encoder unit provides for the mode in question. The preferred purpose of these codebooks is to estimate the dimensions of the input vector that are not considered for quantization. In case the input vector is a frequency domain representation, this corresponds to bandwidth-extension.

The encoder device may be implemented in an encoder system.

Figure 2:
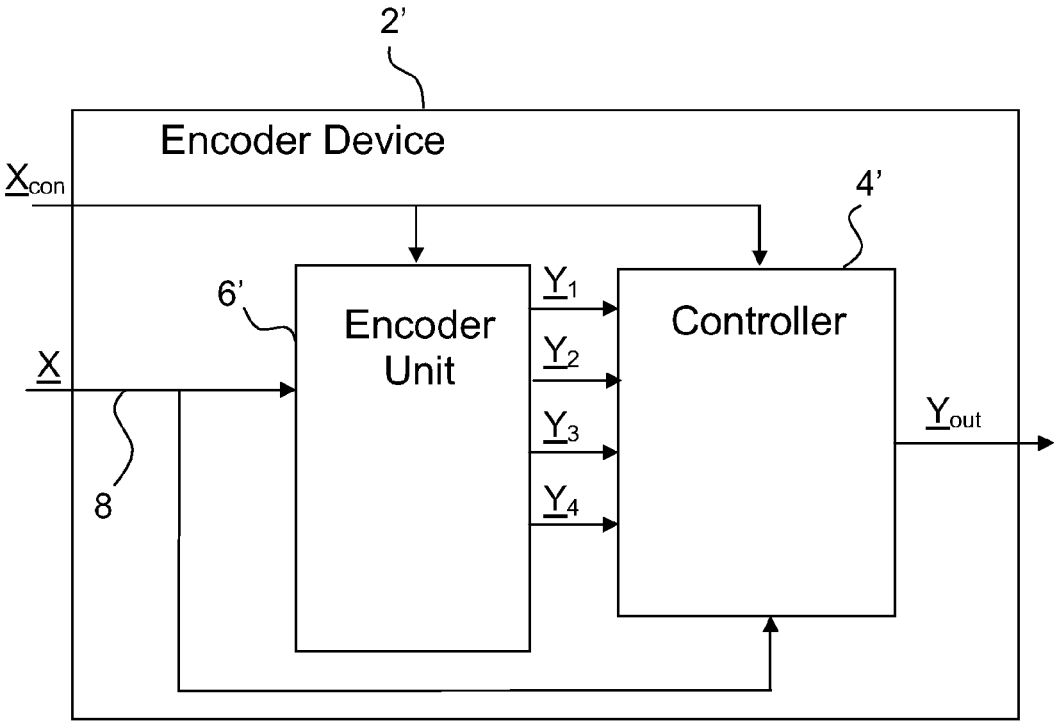

FIG. 1 illustrates an embodiment of an encoder device according to the present invention. The encoder device 2 comprises a controller 4 and an encoder unit 6. The input signal $\underline{X}$ to the encoder device is a digitalized and preferably transformed input signal. Preferably, the input signal $\underline{X}$ has been transformed using MDCT, however other suitable transformation schemes, such as DFT, Wavelet transforms, or the KLT, may be employed. The input signal $\underline{X}$ is fed to the encoder unit 6 on connection 8 either serially or in parallel. The encoder unit 6 is arranged to apply a number M of modes to the input signal. The outputs $\underline{Y}_1, \underline{Y}_2, \ldots, \underline{Y}_M$ of the encoder unit 6 are fed to the controller 4 on connection 10. The outputs $\underline{Y}_1, \underline{Y}_2, \ldots, \underline{Y}_M$ may be fed either serially as illustrated in FIG. 1 or in parallel as shown in FIG. 2 between the encoder unit 6 and the controller 4.

In the encoder unit 6, coefficients of the input signal $\underline{X}$ are optionally preprocessed in a preprocessor by flattening the coefficients of the input signal $\underline{X}$ by a spectrum envelope. The preprocessed or flattened signal is also referred to as the residual signal $\underline{X}_{res}$. Subsequently, the preprocessed signal is encoded or quantized according to different modes including first mode A and second mode B in the encoder unit 6 and the output signals are submitted to the controller 4.

In a preferred embodiment, the number of modes is two, i.e. the encoder unit 6 applies a first mode A and a second mode B to the input signal and feeds the outputs $\underline{Y}_1$ and $\underline{Y}_2$ to the controller 4. In another preferred embodiment, the number of modes is three, i.e. the encoder unit 6 applies a first mode A, a second mode B and a third mode C to the input signal and feeds the outputs $\underline{Y}_1$, $\underline{Y}_2$, and $\underline{Y}_3$ to the controller 4.

The number of modes that is applied is a tradeoff between quality of the encoding and the encoding capacity of the encoder unit 6. In an embodiment, application of four modes A, B, C and D has shown to be a reasonable compromise. With the continuing increase in encoding capacity, a larger number of modes are contemplated, such as five, six, seven, eight, nine, ten, or more.

The controller 4 is arranged to determine the optimum mode of the modes applied in the encoder unit 6. The controller 4 processes the outputs $\underline{Y}_1, \underline{Y}_2, \ldots, \underline{Y}_M$ and forms processed outputs ($\underline{Y}_{m,proc}$, m=1, . . . , M) from at least a part of the respective outputs. Processing of at least one of the outputs comprises estimating a part of the input signal from at least a part of the output that is processed. The controller 4 is arranged to determining an optimum mode based on at least a first processed output and a second processed output.

The optimum mode is selected as the one that minimizes a selection criterion, e.g. a predefined selection criterion. In an embodiment, the optimum mode is selected as the one that maximizes a selection criterion.

The controller 4 is further adapted to include the output corresponding to the optimum mode, e.g. output $\underline{Y}_1$ if the first mode A is the optimum mode, in the encoder output signal $\underline{Y}_{out}$.

Preferably, the encoder output signal $\underline{Y}_{out}$ comprises information about the optimum mode. Alternatively or in combination, the encoder output signal $\underline{Y}_{out}$ may comprise information about the preprocessing of the input signal $\underline{X}$. The encoder output signal $\underline{Y}_{out}$ is transmitted to a receiver and reconstructed or decoded according to a receiver reconstruction codebook, preferably according to information about the optimum mode and/or the preprocessing of the input signal $\underline{X}$. Preferably, the transmitter reconstruction codebook and the receiver reconstruction codebook are identical.

FIG. 2 illustrates an embodiment of the encoder device according to the present invention, wherein the encoder device is adapted to apply four modes to the input signal $\underline{X}$. The encoder device 2' is similar to the encoder device 2 with similar components except that the outputs $\underline{Y}_1$-$\underline{Y}_4$ are fed in parallel from the encoder unit 6' to the controller 4' instead of serially as in FIG. 1. In the illustrated embodiment, four different modes are applied to the input signal.

In the embodiments illustrated in FIGS. 1 and 2, a spectral envelope is applied to the input signal $\underline{X}$ in a preprocessor arranged in the encoder unit or arranged as a preprocessor unit connected to the encoder unit in the encoder device. In an embodiment, the preprocessor is a separate unit external to the encoder device, thus omitting the need for preprocessing of the input signal $\underline{X}$. The spectral envelope may be defined in different ways. The spectral envelope may be static and predefined. However, the spectral envelope may be determined or calculated dynamically based on properties of the input signal, either in frequency domain or in time domain. Accordingly, the properties of the spectral envelope may be controlled in accordance with an external control signal $\underline{X}_{con}$, e.g. from a controller external to the encoder device as illustrated in FIG. 1 or from the controller 4. In an embodiment, the properties of the spectral envelope are controlled based on frequency response of AR coefficients. The spectrum envelope may be calculated through grouping MDCT coefficients and calculating the mean energy in each group. These groups can be of uniform length, or the length can increase towards high-frequency.

Figure 3:
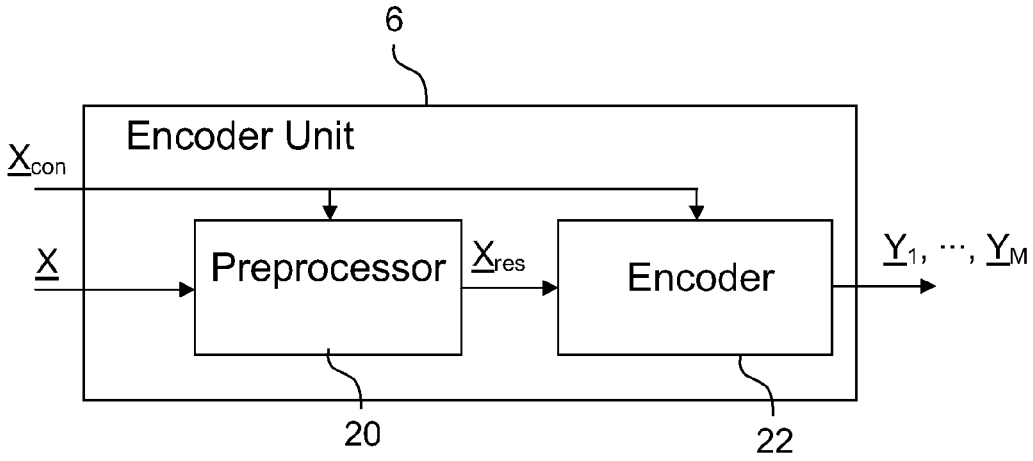

FIG. 3 illustrates an embodiment of the encoder unit 6 of FIG. 1. The encoder unit 6 comprises an optional preprocessor 20 and an encoder 22. The input signal $\underline{X}$ is fed to the preprocessor 20 that is adapted to apply a spectral envelope to the input signal $\underline{X}$ and feed the residual signal $\underline{X}_{res}$ to the encoder 22. The encoder 22 is adapted to encode or quantize the residual signal $\underline{X}_{res}$ according to M different modes and send the resulting outputs serially to the controller as illustrated in FIG. 1. The preprocessor 20 and the encoder 22 are controlled by control signal $\underline{X}_{con}$. $\underline{X}_{con}$ may comprise control variables from a controller external to the encoder device and/or control variables from controller 4.

Figure 4:
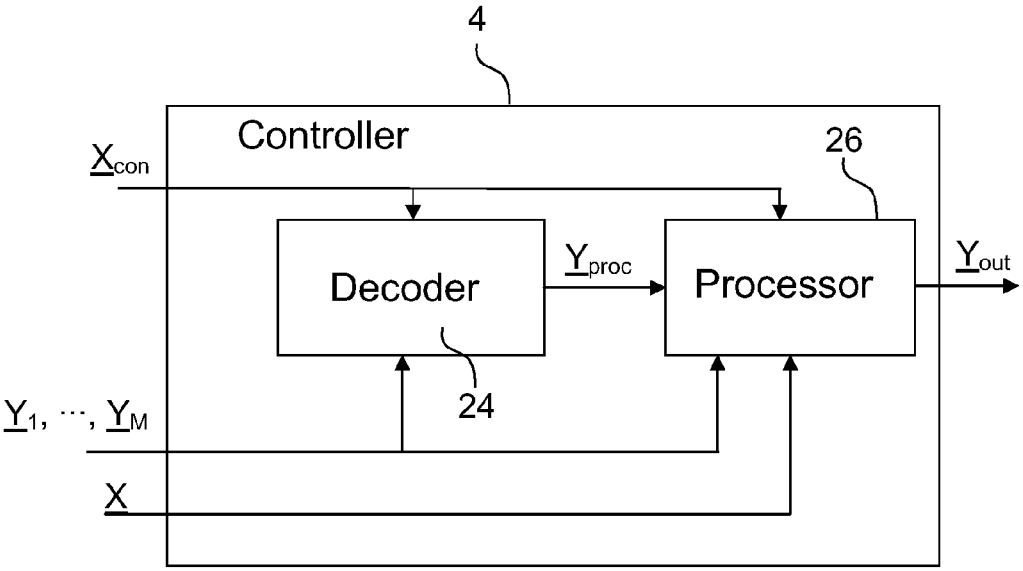

FIG. 4 illustrates an embodiment of the controller 4 of FIG. 1. The controller 4 comprises a decoder 24 and a processor 26. The outputs $\underline{Y}_1, \underline{Y}_2, \ldots, \underline{Y}_M$ are processed in the decoder 24, which decodes the outputs $\underline{Y}_1, \underline{Y}_2, \ldots, \underline{Y}_M$ according to a transmitter reconstruction codebook including estimation of at least a part of the input signal. The processed or decoded outputs $\underline{Y}_{m,proc}$ for all M modes are serially fed to the processor 26 that is adapted to determine the optimum mode based on the processed signals $\underline{Y}_{m,proc}$ for all modes or selected modes and the input signal $\underline{X}$.

In the illustrated embodiment, the controller 4 is adapted to solve the minimization problem given by $m^{(*)}=\arg\min_m D(\underline{X}, \underline{Y}_{m,proc})$, where $m^{(*)}$ is the optimum mode, D is the distortion, $m=(1, \ldots, M)$ is the index over M modes, $\underline{X}=(x_0, \ldots, x_{N-1})$ is the input signal, and $\underline{Y}_{m,proc}=(y_0, \ldots, y_{N-1})_{m,proc}$ is the processed output for mode m.

The distortion D is given by:

$$D = \frac{1}{N}\sum_{n=0}^{N-1} (x_n^* - y_n^*)^{\beta_n},$$

where N is the number of coefficients in the input signal, i.e. the vector dimension, $$x_0^* = |x_0| \text{ and } x_n^* = (1-\alpha_n)|x_n| + \alpha_n x_{n-1}^* \text{ for all } 1 \le n < N,$$

$$y_0^* = |y_0| \text{ and } y_n^* = (1-\alpha_n)|y_n| + \alpha_n y_{n-1}^* \text{ for all } 1 \le n < N,$$

-continued $$\alpha_n = \left(\frac{n}{N}\right)^6, \text{ and } \beta_n = \begin{cases} 4, \text{ if } (x_n^* - y_n^*) < 0 \\ 2, \text{ if } (x_n^* - y_n^*) \ge 0. \end{cases}$$

In an embodiment $\beta_n$ is a constant value, e.g. $\beta_n=2$ for all n.

The sign is removed from the vector coefficients and they are smoothed. In this embodiment, the weighting factor $\alpha_n$ increases towards high-frequencies (with N—the dimension of the vector), however the weighting factor $\alpha_n$ may take any suitable form.

The "penalty factor" $\beta_n$ may add heavier penalty for "new" spectral components, and less for "missing" spectral components as indicated above or vice versa. Such penalty factor has previously not been applied to the area of speech/audio coding.

When the computation of the criterion $D(\underline{X},\underline{Y}_{m,proc})$, for all modes M imposes a too high complexity, it is possible to calculate the criterion for only a subset of all modes. Then the criterion may be interpolated or omitted for the remaining modes. This allows having more modes to choose from than criteria to calculate and saves the computation of D and $\underline{Y}_{m,proc}$ for the modes, which the criterion is interpolated to. In other words: A high resolution in the transition from coding to bandwidth extension (BWE) is achieved while the computational complexity of the algorithm is kept low.

The controller 4 is further adapted to include the output according to the optimum mode in the encoder output signal $\underline{Y}_{out}$. The control signal $\underline{X}_{con}$ may comprise information about the spectral envelope applied in the preprocessor 20. The encoder output signal $\underline{Y}_{out}$ may comprise information about the optimum mode and/or information about the spectral envelope applied in the preprocessor 20.

It is an important advantage of the invention that the determination of the optimum mode is based on a comparison of the input signal and the decoded output signal, instead of dynamically adapting the encoding or quantization according to properties of the input signal as suggested in the prior art.

Figure 5:
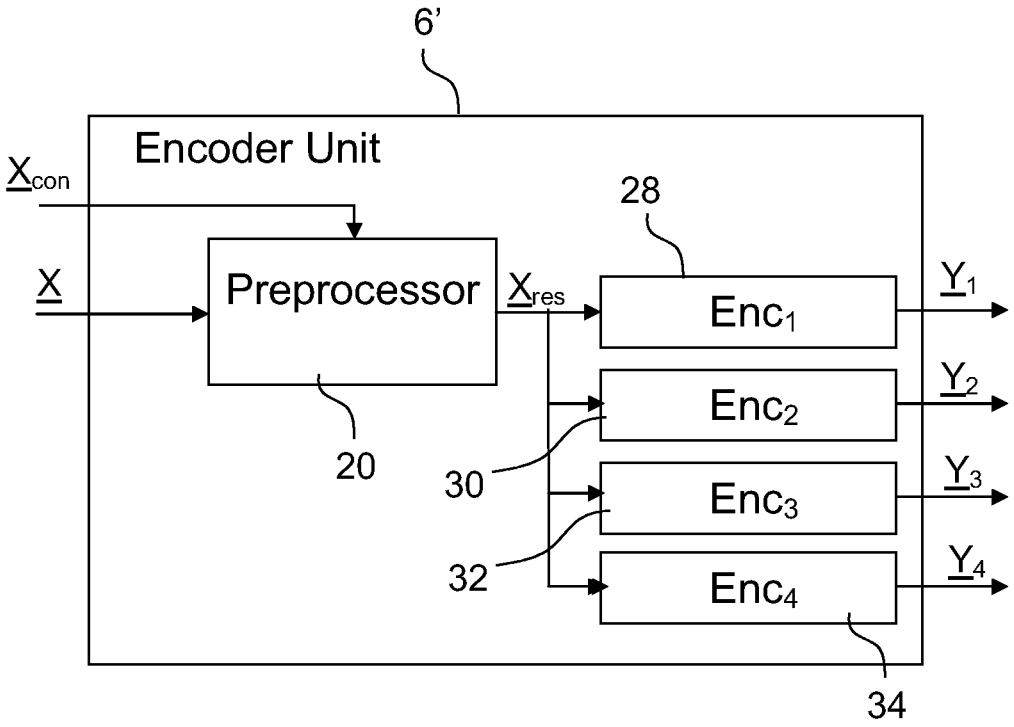

FIG. 5 illustrates an embodiment of the encoder unit 6' of FIG. 2. The encoder unit 6' comprises optional preprocessor 20 and four encoders 28, 30, 32, and 34, one for each mode. The input signal $\underline{X}$ is fed to the preprocessor 20 that is adapted to apply a spectral envelope to the input signal $\underline{X}$ according to a control signal $\underline{X}_{con}$ and/or predefined operating parameters. The residual signal $\underline{X}_{res}$ or the input signal $\underline{X}$ in case the preprocessor is omitted is then fed to the encoders 28, 30, 32, and 34. The encoders 28, 30, 32, and 34 encode the residual signal $\underline{X}_{res}$ or the input signal $\underline{X}$ by applying four different modes to the residual signal $\underline{X}_{res}$ or the input signal $\underline{X}$. The outputs $\underline{Y}_1, \underline{Y}_2, \underline{Y}_3, \underline{Y}_4$ are fed in parallel to the controller. Each of the encoders 28, 30, 32, and 34 may be adapted to encode according to a plurality of modes and feed a plurality of outputs serially to the controller. Accordingly a combination of serial and parallel feed of the output signals $\underline{Y}$ to the controller may be employed.

In the illustrated embodiment, the encoders 28, 30, 32, and 34 operate according to predefined operating parameters, however the operation of the encoders 28, 30, 32, and 34 may be dynamically controlled by control signal $\underline{X}_{con}$.

Figure 6:
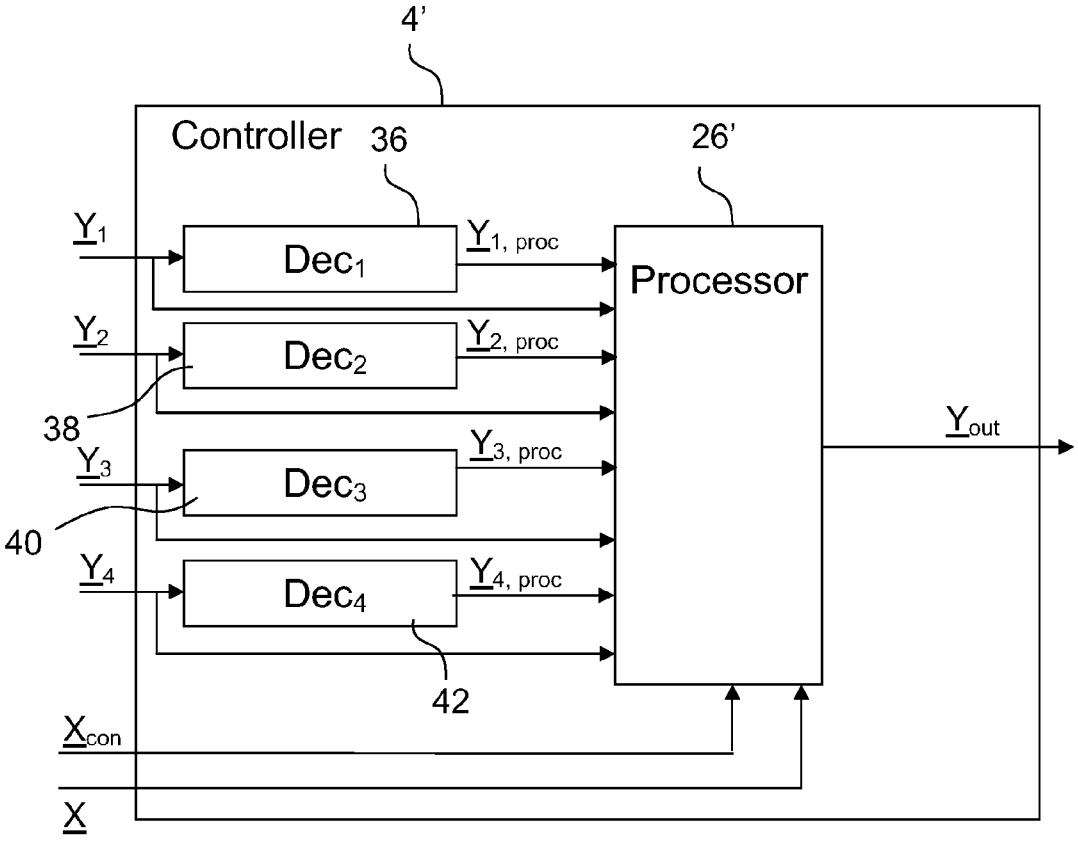

FIG. 6 illustrates an embodiment of the controller 4' of FIG. 2. The controller 4' is similar to the controller 4 described in connection with FIG. 4 except that a decoder 36, 38, 40, 42 is provided for each output $\underline{Y}_1, \underline{Y}_2, \underline{Y}_3, \underline{Y}_4$ such that the outputs are processed or decoded in parallel and not serially as in the controller 4. The controller 4' further comprises a processor 26' that is adapted to determine the optimum mode based on the processed signals $\underline{Y}_{m,proc}$ for all modes or selected modes and the input signal X. The decoders 36, 38, 40, 42 process or decodes the outputs $\underline{Y}_1$, $\underline{Y}_2$, $\underline{Y}_3$, $\underline{Y}_4$ according to a transmitter reconstruction codebook. The decoders 36, 38, 40, 42 may each be adapted to decode a plurality of outputs that are fed in serial to the decoders 36, 38, 40, 42.

Figure 7:
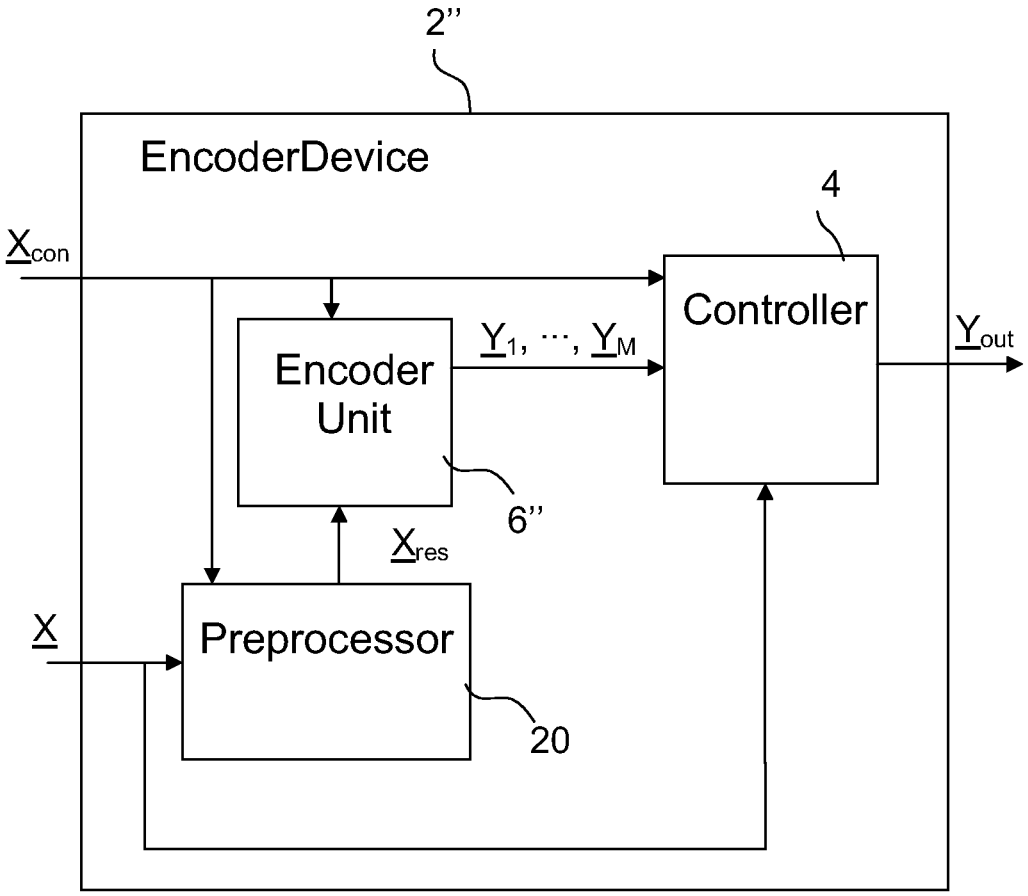

FIG. 7 illustrates an embodiment of the encoder device according to the invention. In the encoder device 2", the input signal $\ddot{X}$ is preprocessed with a spectral envelope and the residual signal $\underline{X}_{res}$ is fed to the encoder unit 6".

Figure 8:
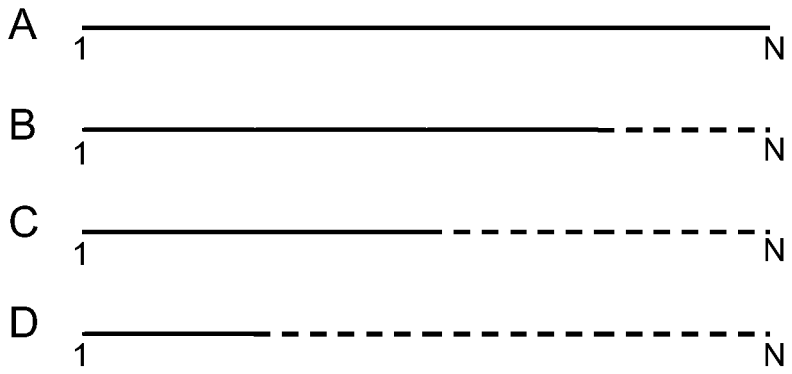
FIG. 8 illustrates different modes applied in the encoder device and the method according to the present invention, FIG. 9 schematically illustrates an embodiment of the method according to the present invention, FIG. 10 schematically illustrates an embodiment of the method according to the present invention.

FIG. 8 illustrates an example of having four different modes A, B, C, and D. When the first mode A is applied, e.g. in one of the encoder devices 2, 2', 2", the entire input signal, optionally preprocessed, is quantized as shown with solid line, thus the available bits are spread over all dimensions 0 to N−1. In the second mode B, the available bits are used for quantization of the first three fourths of the vector as illustrated by the solid line, and the remaining dimensions or coefficients as indicated by the dashed line, i.e. the frequencies corresponding to the unquantized part of the vector, are to be reconstructed according to a reconstruction codebook. In the third mode C, the available bits are used for quantization of the first half of the vector, and the remaining half, i.e. the frequencies corresponding to the unquantized part of the vector, are to be reconstructed or estimated using bandwidth extension, i.e. according to a reconstruction codebook. In the fourth mode D, all bits are spent for quantization of the lower-quarter of the vector, and the remaining dimensions are reconstructed.

In general, with decreasing the bit-budget the preference of the modes goes from quantizing a larger portion of the spectrum to a smaller portion of the spectrum (going from modes A→D in FIG. 8, as human perception is more sensitive to fine-structure errors in low-frequency regions. If enough bits are available, and the low-frequency regions are quantized with sufficient resolution, the preferred modes in the above example will be A and B. With increasing self-similarity of the signal, the preference goes from coding a large fraction of the spectrum to a smaller fraction of it (A→D in the example of FIG. 8), as the process of reconstruction introduces less artifacts.

By searching through all modes, the encoder device balances between high resolution quantization of low-frequency regions and introducing artifacts in high-frequency regions, improving the quality of the encoded signal.

Figure 9:
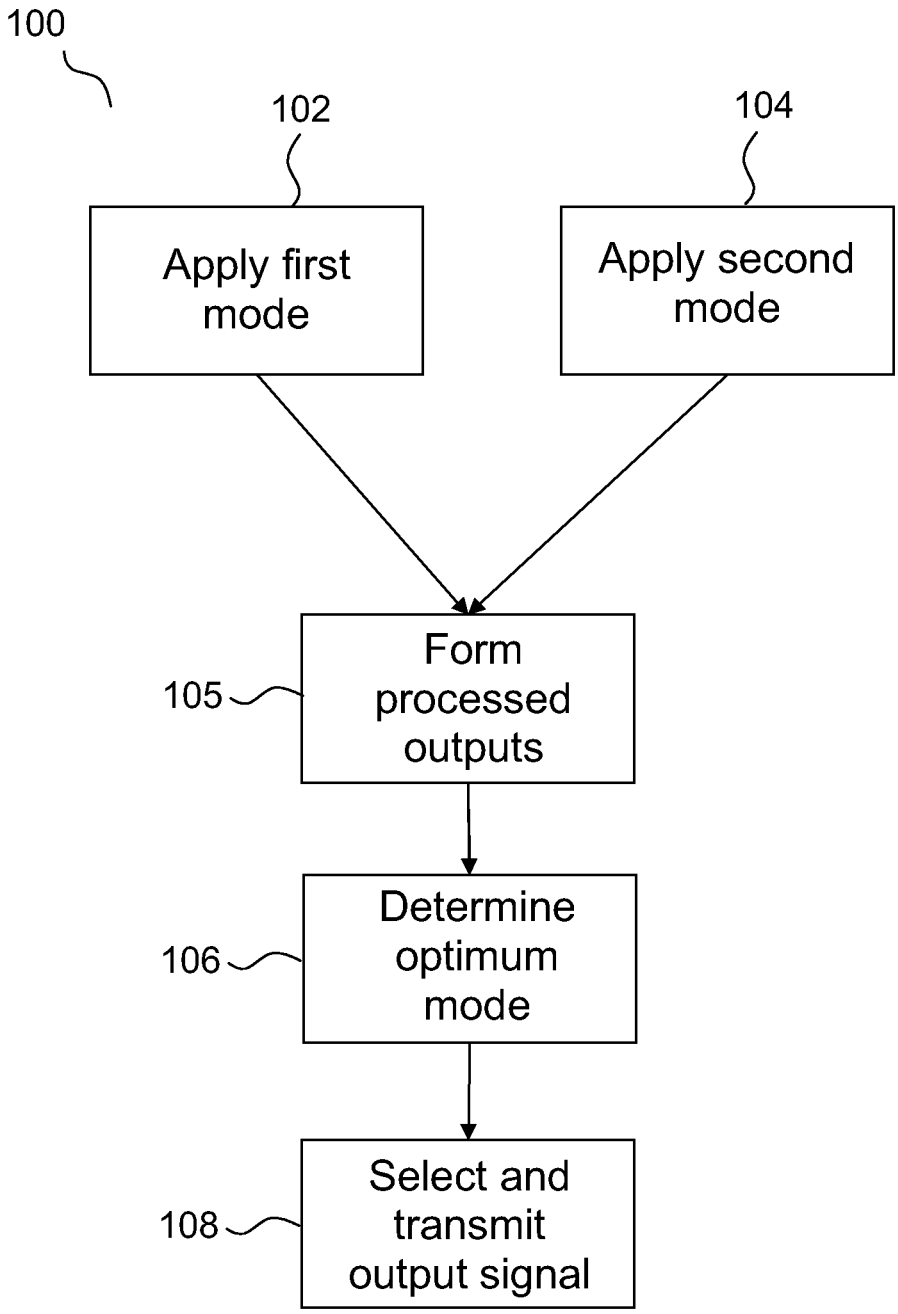
Figure 10:
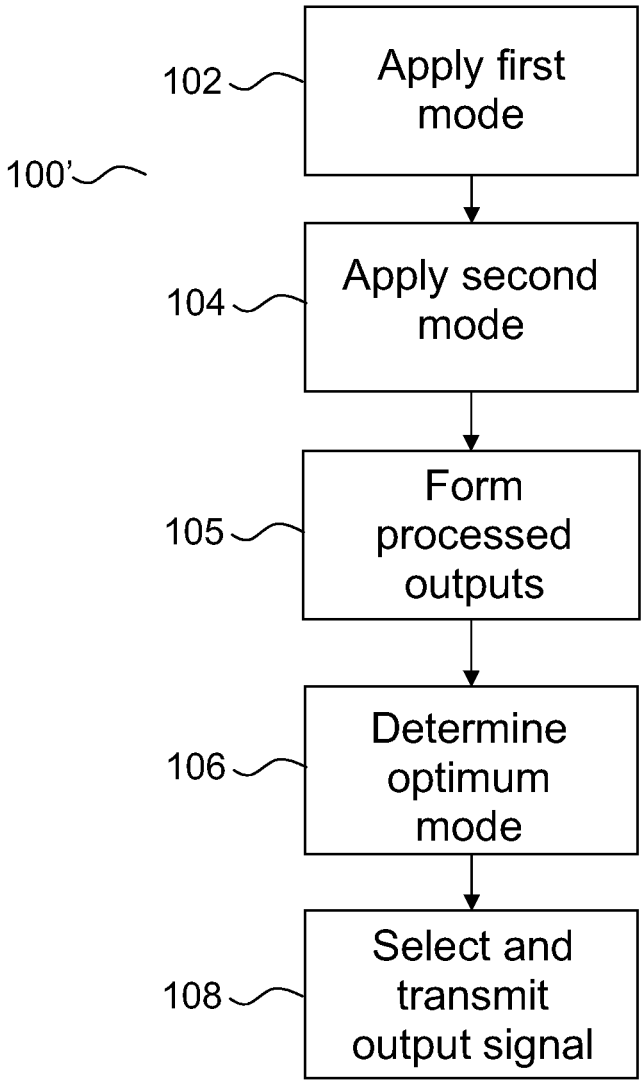

FIG. 9 and FIG. 10 illustrate embodiments of the method for coding an input signal in an encoder system according to the present invention. The methods 100, 100' comprise a step 102 of applying a first mode to the input signal X or the residual of the input signal to form a first output. Further the method comprises a step 104 of applying a second mode to the input signal or the residual of the input signal to form a second output. The steps 102 and 104 may be performed in parallel as in FIG. 9 or serially as in FIG. 10. Further modes may be applied in parallel or performed serially. Steps 102 and 104 comprise quantizing parts of the input signal or the residual signal of the input signal, i.e. quantizing a first part of the input signal for the first mode and quantizing a second part of the input signal for the second mode.

Upon or during application of the modes, the method 100, 100' proceeds to the step 105 of forming a first processed output from at least a part of the first output, and a second processed output from at least a part of the second output, wherein forming a second processed output comprises estimating a part of the input signal from at least a part of the second output. Then in step 106 an optimum mode is determined based on the first processed output and the second processed output. In the illustrated embodiments, step 106 comprises solving the minimization problem given by $m^{(*)} = \arg\min_m D(\underline{X}, \underline{Y}_{m,proc})$, where $m^{(*)}$ is the optimum mode, D is the distortion, $\underline{m}=(1, \ldots, M)$ is the index over M modes (M=2 in this embodiment), $\underline{X}=(x_0, \ldots, x_{N-1})$ is the input signal, and $\underline{Y}_{m,proc}=(y_0, \ldots, y_{N-1})_{m,proc}$ is the processed output for mode $\underline{m}$. The residual signal $\underline{X}_{res}$ of the input signal may replace the input signal $\underline{X}$.

The distortion D is given by:

$$D = \frac{1}{N}\sum_{n=0}^{N-1} (x_n^* - y_n^*)^{\beta_n},$$

where N is the number of coefficients in the input signal, i.e. the vector dimension, $$x_0^* = |x_0| \text{ and } x_n^* = (1-\alpha_n)|x_n| + \alpha_n x_{n-1}^* \text{ for all } 1 \le n < N,$$

$$y_0^* = |y_0| \text{ and } y_n^* = (1-\alpha_n)|y_n| + \alpha_n y_{n-1}^* \text{ for all } 1 \le n < N,$$

$$\alpha_n = \left(\frac{n}{N}\right)^6, \text{ and } \beta_n = \begin{cases} 4, \text{ if } (x_n^* - y_n^*) < 0 \\ 2, \text{ if } (x_n^* - y_n^*) \ge 0. \end{cases}$$

Upon determination of the optimum mode in step 106, the method 100, 100' proceeds to the step 108 of selecting the output according to the optimum mode. Step 108 comprises transmitting or indicating information about the selected mode together with transmitting the selected output signal.

The method according to the present invention may be applied to each frame of the input signal or at a certain frequency, e.g. the method may be applied to every tenth frame and the optimum mode applied for the frames until the next determination of the optimum mode.

The multi-mode scheme according to the present invention by residual quantization offers an improved quality in transform audio coding schemes. The improvement comes through selection of the optimal mode, for the current bitrate and input source characteristics.

Figure 11:
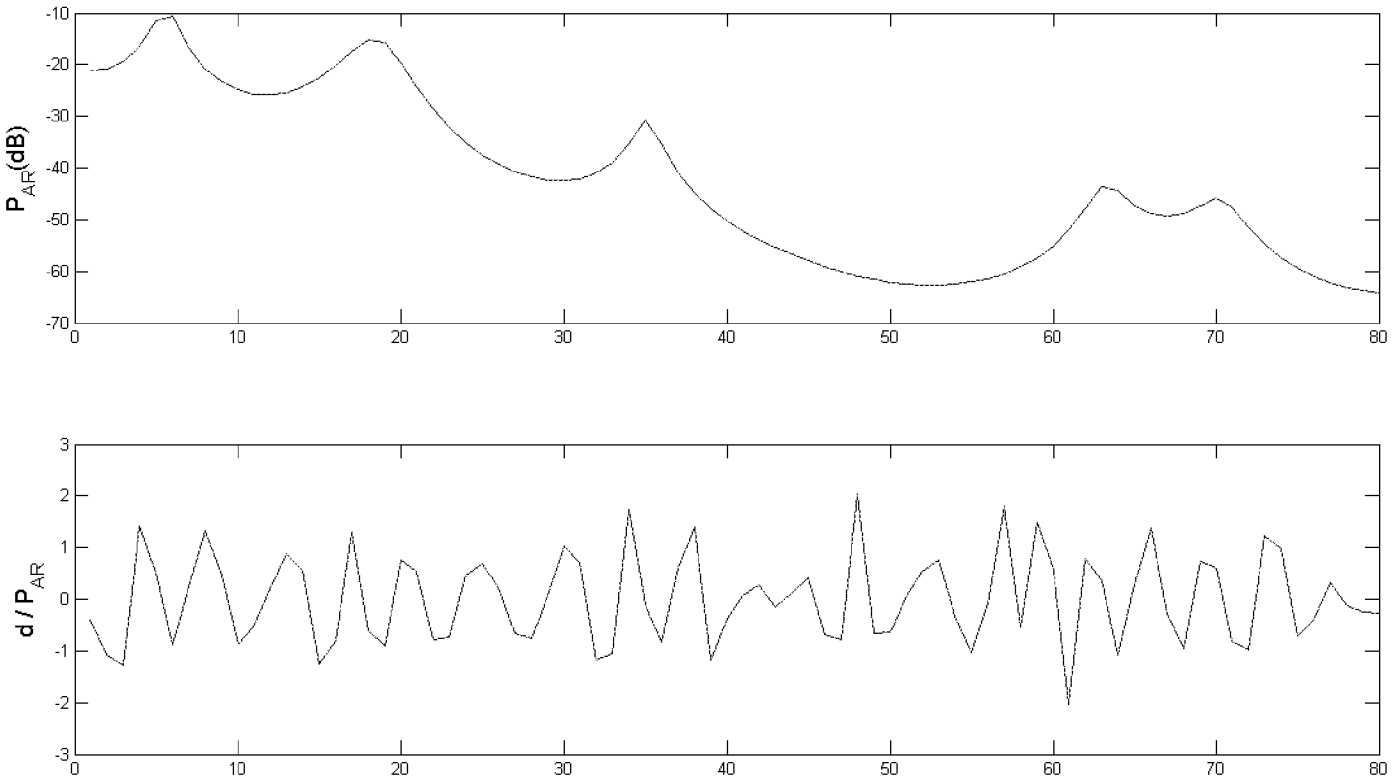
FIG. 11 shows a spectrum envelope and compressed residual for a 20 ms speech frame.

Simulations were performed with the spectrum envelope and compressed residual of FIG. 11, modes according to FIG. 8, and wideband sources. Table 1 and Table 2 provide statistics of the mode selection with bit rate and source type (Speech—German male and Music—Castanets).

Table 3 illustrates the overall quality improvement of the multi-mode scheme in comparison with the conventional solutions.

TABLE 1

| Speech - German male | | | | |
|---|---|---|---|---|
| | Mode A | Mode B | Mode C | Mode D |
| 12 kb/s | 4.8% | 14.6% | 11.3% | 69.4% |
| 22 kb/s | 16.7% | 7.9% | 26.3% | 49.2% |
| 32 kb/s | 15.2% | 16.7% | 51.8% | 16.4% |

TABLE 2

| Music - Castanets | | | | |
|---|---|---|---|---|
| | Mode A | Mode B | Mode C | Mode D |
| 12 kb/s | 3.4% | 4.2% | 6.3% | 86.1% |
| 22 kb/s | 3.6% | 24.5% | 35.7% | 36.2% |
| 32 kb/s | 3.2% | 55.7% | 36.9% | 4.2% |

TABLE 3

| Performance, WB-PESQ according to ITU-T Rec. P.862.2 | | | |
|---|---|---|---|
| | Multi-mode scheme | Quantize entire spectrum | Quantize lower-half and reconstruct upper-half of the spectrum |
| 12 kb/s | 3.528 | 3.387 | 3.399 |
| 22 kb/s | 3.819 | 3.592 | 3.739 |
| 32 kb/s | 3.876 | 3.775 | 3.864 |

The transmitter and receiver reconstruction codebook may be generated from the spectral coefficients in the quantized regions of the spectrum. Typically, quantization algorithms will distribute the available total bit budget to only a subset of the coefficients in the quantized regions. The remaining coefficients are typically either set to zero or approximated by some other algorithm, e.g., noise fill algorithms. For the reconstruction codebooks this opens several alternatives how to construct the reconstruction codebook. The coefficients in the quantized regions of the spectrum that do not receive any bits can be either omitted in the reconstruction codebook, they can be set to zero or their estimated value can be used.

The spectral coefficients received this way are not necessarily used directly to reconstruct high-frequency regions, but can be processed to create a reconstruction codebook. An example of such a processing consists of two steps: 1) Compression of the top ten % coefficients with largest absolute values. The 0.1N coefficients with the highest absolute value are set to the maximum absolute value of the remaining coefficients. 2) Overall energy attenuation (only 70% of initial level is retained).

Attenuation of the vector in the reconstruction codebook typically leads to loss of energy in the high-frequency part of the spectrum. At the decoder this can be compensated with a tilt compensation filter of the form $H(z)=1-\mu\cdot z^{-1}$, where μ may have any suitable value, e.g. $\mu=0.4$.

Alternative form of a filter that compensate the high-frequency loss is $H(z)=\alpha\cdot z^{-1}-\beta+\alpha\cdot z^{+1}$, where e.g. $\alpha=0.0825$ and $\beta=0.5825$.

These tilt compensation filters may be combined with conventional formant or pitch post-filters.

On the receiver side, the decoder gets the mode information from the mode information included in the received signal, thereby defining which parts of the input signal spectrum that has been quantized at the decoder and what shall be reconstructed. The quantized part of the spectrum is directly used. Then the reconstruction codebook is generated as explained above and used to populate the non-quantized parts of the spectrum. Now two situations can be distinguished: a) the extended region is larger than the reconstruction codebook b) the extended region is smaller than the reconstruction codebook. For case a) the reconstruction codebook is repeated until the entire spectrum is populated. For case b) the reconstruction codebook is simply truncated.

Coming back to the example of FIG. 8, only ⅓ of the reconstruction codebook is used for mode B, for mode C the reconstruction codebook fits exactly, and for mode D the reconstruction codebook has to be repeated twice. Here we assumed that coefficients in the quantized regions that received no bits for quantization are included in the reconstruction codebook.

The optional tilt compensation filter may be applied and finally the spectral envelope is imposed on the entire spectrum in addition with other optional processing steps, e.g. post-filters, not related to the current invention.

It should be noted that in addition to the exemplary embodiments of the invention shown in the accompanying drawings, the invention may be embodied in different forms and should not be construed as limited to the embodiments set forth herein. Rather, these embodiments are provided so that this disclosure will be thorough and complete, and will fully convey the concept of the invention to those skilled in the art.

The invention claimed is:

1. A method for coding an input signal in an encoder system, wherein the method comprises the steps of:

applying a first mode to the input audio signal (X) to form a first output ($Y_1$);

applying a second mode to the input audio signal (X) to form a second output ($Y_2$);

forming a first processed output ($Y_{1,proc}$) from at least a part of the first output ($Y_1$), and a second processed output ($Y_{2,proc}$) from at least a part of the second output ($Y_2$), wherein forming a second processed output comprises estimating a part of the input signal from at least a part of the second output ($Y_2$);

determining an optimum mode based on the first processed output ($Y_{1,proc}$) and the second processed output ($Y_{2,proc}$), and on a selection criterion calculated from the input signal and the processed outputs, wherein the selection criterion is defined as a minimization problem given as:

$$m^{(*)}=arg\ \min_m D(\underline{X},\underline{Y}_{m,proc});$$

where $m^{(*)}$ is the optimum mode m, D is the distortion, m=(1, . . . , M) is the index over M modes or m is the index over a subset of M modes, $\underline{X}=(x_0, \ldots, x_{N-1})$ is the input signal, and $\underline{Y}=(y_0, \ldots, y_{N-1})_{m,proc}$ is the processed output for mode, wherein the distortion D for at least one mode is given by:

$$D=\frac{1}{N}\sum_{n=0}^{N-1}(x_n^*-y_n^*)^{\beta_n},$$

wherein N is the number of coefficients in the input signal, $$x_0^*=|x_0| \text{ and } x_n^*=(1-\alpha_n)|x_n|+\alpha_n x_{n-1}^* \text{ for all } 1\le n<N,$$

$$y_0^*=|y_0| \text{ and } y_n^*=(1-\alpha_n)|y_n|+\alpha_n y_{n-1}^* \text{ for all } 1\le n<N,$$

$$\alpha_n=\left(\frac{n}{N}\right)^6, \text{ and } \beta_n=\begin{cases}4, \text{ if } (x_n^*-y_n^*)<0\\ 2, \text{ if } (x_n^*-y_n^*)\ge 0\end{cases}; \text{ and}$$

selecting the output ($Y_1$, $Y_2$) according to the optimum mode.

2. The method according to claim 1, wherein the step of applying a first mode to the input signal comprises quantizing a first part of the input signal.

3. The method according to claim 2, wherein the step of applying a second mode to the input signal comprises quantizing a second part of the input signal.

4. The method according to claim 1, wherein forming a second processed output comprises reconstructing a part of the input signal using bandwidth extension.

5. The method according to claim 1, wherein M>2 modes are applied to the input signal to form M outputs.

6. The method according to claim 1, wherein the distortion D is estimated for at least one mode.

7. The method according to claim 1, further comprising the step of transmitting information about the optimum mode.

8. A method for coding an input signal in an encoder system, wherein the method comprises the steps of:

applying a first mode to the input audio signal (X) to form a first output ($Y_1$;

applying a second mode to the input audio signal (X) to form a second output ($Y_2$);

forming a first processed output ($Y_{1,proc}$) from at least a part of the first output ($Y_1$), and a second processed output ($Y_{2,proc}$) from at least a part of the second output ($Y_2$), wherein forming a second processed output comprises estimating a part of the input signal from at least a part of the second output ($Y_2$);

determining an optimum mode based on the first processed output ($Y_{1,proc}$) and the second processed output ($Y_{2,proc}$), and on a selection criterion calculated from the input signal and the processed outputs, wherein the selection criterion is defined as a minimization problem given as:

$$m^{(*)}=arg\ \min_m D(\underline{X},\underline{Y}_{m,proc});$$

where $m^{(*)}$ is the optimum mode m, D is the distortion, m=(1, . . . , M) is the index over M modes or in is the index over a subset of M modes, $\underline{X}=(x_0, \ldots, x_{N-1})$ is the input signal, and $\underline{Y}_{m,proc}=(y_0, \ldots, y_{N-1})_{m,proc}$ is the processed output for mode, wherein the distortion D for at least one mode is given by:

$$D = \frac{1}{N_I}\sum_{n\in I}(x_n^* - y_n^*)^{\beta_n},$$

where N is the number of coefficients in the input signal, I is a subset of integers from 0 to N−1, $N_1$ is the number of elements in I, $$x_0^* = |x_0| \text{ and } x_n^* = (1-\alpha_n)|x_n| + \alpha_n x_{n-1}^* \text{ for all } 1 \le n < N,$$

$$y_0^* = |y_0| \text{ and } y_n^* = (1-\alpha_n)|y_n| + \alpha_n y_{n-1}^* \text{ for all } 1 \le n < N,$$

$$\alpha_n = \left(\frac{n}{N}\right)^6, \text{ and } \beta_n = \begin{cases} 4, \text{ if } (x_n^* - y_n^*) < 0 \\ 2, \text{ if } (x_n^* - y_n^*) \ge 0 \end{cases}; \text{ and}$$

selecting the output ($Y_1$, $Y_2$) according to the optimum mode.

9. The method according to claim 8, wherein the distortion D is estimated for at least one mode.

10. An encoder device comprising;

a controller; and an encoder unit connected to the controller, the encoder unit being arranged for applying a first mode to an input signal (X) to form a first output ($Y_1$) and being arranged for applying a second mode to the input signal (X) to form a second output ($Y_2$), wherein the controller is arranged for forming a first processed output ($Y_{1,proc}$) from at least a part of the first output ($Y_1$), and a second processed output ($Y_{2,proc}$) from at least a part of the second output ($Y_2$), wherein forming a second processed output comprises estimating a part of the input signal from at least a part of the second output ($Y_2$), and determining an optimum mode based on the first processed output and the second processed output, and on a selection criterion calculated from the input signal and the processed outputs, wherein the selection criterion is defined as a minimization problem given as: $m^{(*)}$=arg $\min_m$ $D(\underline{X},\underline{Y}_{m,proc})$ where $m^{(*)}$ is the optimum mode m, D is the distortion, m=(1, . . . , M) is the index over M modes or m is the index over a subset of M modes, $\underline{X}=(x_0, \ldots, x_{N-1})$ is the input signal, and $\underline{Y}_{m,proc}=(y_0, \ldots, y_{N-1})_{m,proc}$ is the processed output for mode m, wherein the distortion D for at least one mode is given by:

$$D = \frac{1}{N_I}\sum_{n\in I}(x_n^* - y_n^*)^{\beta_n},$$

where N is the number of coefficients in the input signal, $$x_0^* = |x_0| \text{ and } x_n^* = (1-\alpha_n)|x_n| + \alpha_n x_{n-1}^* \text{ for all } 1 \le n < N,$$

$$y_0^* = |y_0| \text{ and } y_n^* = (1-\alpha_n)|y_n| + \alpha_n y_{n-1}^* \text{ for all } 1 \le n < N,$$

$$\alpha_n = \left(\frac{n}{N}\right)^6, \text{ and } \beta_n = \begin{cases} 4, \text{ if } (x_n^* - y_n^*) < 0 \\ 2, \text{ if } (x_n^* - y_n^*) \ge 0 \end{cases}; \text{ and}$$

selecting the output ($Y_1$, $Y_2$) according to the optimum mode.

11. The encoder device according to claim 10, wherein the encoder unit comprises an encoder being adapted to serially apply the first mode and the second mode and serially forward the first output and the second output to the controller on a first connection.

12. The encoder device according to claim 10, wherein the encoder unit comprises a first encoder and a second encoder, wherein:

the first encoder is arranged for applying the first mode and arranged for forwarding the first output to the controller on a first connection; and the second encoder is arranged for applying the second mode and arranged for forwarding the second output to the controller on a second connection.

13. The encoder device according to claim 12, wherein the controller comprises:

at least one decoder arranged for forming the first processed output and the second processed output according to the first and second mode, respectively; and a processor arranged for determining the optimum mode based on a selection criterion calculated from the input signal and the first processed output and the second processed output.

14. The encoder device according to claim 10, wherein the controller comprises:

at least one decoder arranged for forming the first processed output and the second processed output according to the first and second mode, respectively; and a processor arranged for determining the optimum mode based on a selection criterion calculated from the input signal and the first processed output and the second processed output.

15. An encoder system comprising an encoder device according to claim 10.

16. An encoder device comprising;

a controller; and an encoder unit connected to the controller, the encoder unit being arranged for applying a first mode to an input signal (X) to form a first output ($Y_1$) and being arranged for applying a second mode to the input signal (X) to form a second output ($Y_2$), wherein the controller is arranged for forming a first processed output ($Y_{1,proc}$) from at least a part of the first output ($Y_1$), and a second processed output ($Y_{2,proc}$) from at least a part of the second output ($Y_2$), wherein forming a second processed output comprises estimating a part of the input signal from at least a part of the second output ($Y_2$), and determining an optimum mode based on the first processed output and the second processed output, and on a selection criterion calculated from the input signal and the processed outputs, wherein the selection criterion is defined as a minimization problem given as: $m^{(*)}=\arg\min_m D(\underline{X},\underline{Y}_{m,proc})$, where $m^{(*)}$ is the optimum mode m, D is the distortion, m=(1, . . . , M) is the index over M modes or m is the index over a subset of M modes, $\underline{X}=(x_0, \ldots, x_{N-1})$ is the input signal, and $\underline{Y}_{m,proc}=(y_0, \ldots, y_{N-1})_{m,proc}$ is the processed output for mode m, wherein the distortion D for at least one mode is given by:

$$D = \frac{1}{N_I}\sum_{n\in I}(x_n^* - y_n^*)^{\beta_n},$$

where N is the number of coefficients in the input signal, I is a subset of integers from 0 to N−1, $N_1$ is the number of elements in I, $$x_0^* = |x_0| \text{ and } x_n^* = (1-\alpha_n)|x_n| + \alpha_n x_{n-1}^* \text{ for all } 1 \le n < N,$$

$$y_0^* = |y_0| \text{ and } y_n^* = (1-\alpha_n)|y_n| + \alpha_n y_{n-1}^* \text{ for all } 1 \le n < N,$$

$$\alpha_n = \left(\frac{n}{N}\right)^6, \text{ and } \beta_n = \begin{cases} 4, \text{ if } (x_n^* - y_n^*) < 0 \\ 2, \text{ if } (x_n^* - y_n^*) \ge 0 \end{cases}; \text{ and}$$

selecting the output ($Y_1$, $Y_2$) according to the optimum mode.

* * * * *

UNITED STATES PATENT AND TRADEMARK OFFICE

CERTIFICATE OF CORRECTION

PATENT NO. : 8,494,864 B2
APPLICATION NO. : 12/996959
DATED : July 23, 2013
INVENTOR(S) : Grancharov et al.

It is certified that error appears in the above-identified patent and that said Letters Patent is hereby corrected as shown below:

In The Specification

In Column 4, Line 10, delete "$y_{0=}$" and insert -- $y^*_{0=}$ --, therefor.

In Column 7, Line 50, delete "$Y_{m,proc}$=" and insert -- $\underline{Y}_{m,proc}$= --, therefor.

In Column 9, Line 9, delete "□" and insert -- $\underline{X}$ --, therefor.

In Column 9, Line 32, delete "(going" and insert -- going --, therefor.

In The Claims

In Column 12, Line 43, in Claim 1, delete "$\underline{Y}$=" and insert -- $\underline{Y}_{m,proc}$= --, therefor.

In Column 13, Line 16, in Claim 8, delete "($Y_1$;" and insert -- ($Y_1$); --, therefor.

In Column 13, Line 36, in Claim 8, delete "or in" and insert -- or m --, therefor.

In Column 13, Line 64, in Claim 10, delete "comprising;" and insert -- comprising: --, therefor.

In Column 14, Line 15, in Claim 10, delete "D($\underline{X}$,$\underline{Y}_{m,proc}$)" and insert -- D($\underline{X}$,$\underline{Y}_{m,proc}$), --, therefor.

In Column 14, Line 25, in Claim 10, delete "$D = \frac{1}{N_I}\sum_{n\in I}(x_n^* - y_n^*)^{\beta_n}$," and insert -- $D = \frac{1}{N}\sum_{n=0}^{N-1}(x_n^* - y_n^*)^{\beta_n}$, --, therefor.

In Column 15, Line 7, in Claim 16, delete "comprising;" and insert -- comprising: --, therefor.

Signed and Sealed this
Twenty-sixth Day of April, 2016

Michelle K. Lee

Michelle K. Lee
*Director of the United States Patent and Trademark Office*